US007020603B2

(12) United States Patent
Lopez-Estrada

(10) Patent No.: US 7,020,603 B2
(45) Date of Patent: Mar. 28, 2006

(54) AUDIO CODING AND TRANSCODING USING PERCEPTUAL DISTORTION TEMPLATES

(75) Inventor: Alex A Lopez-Estrada, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 643 days.

(21) Appl. No.: 10/071,653

(22) Filed: Feb. 7, 2002

(65) Prior Publication Data

US 2003/0149559 A1 Aug. 7, 2003

(51) Int. Cl.
*G10L 19/00* (2006.01)

(52) U.S. Cl. ..... 704/200.1; 704/500

(58) Field of Classification Search ..... 704/200, 704/200.1, 222, 229, 230, 500–504
See application file for complete search history.

(56) References Cited

U.S. PATENT DOCUMENTS 6,499,008 B1 * 12/2002 Miet ..... 704/200.1
6,577,996 B1 * 6/2003 Jagadeesan ..... 704/236
2001/0047256 A1 * 11/2001 Tsurushima et al. ..... 704/200

OTHER PUBLICATIONS

Madisetti et al.; Digital Signal Processing Hand Book; IEEE Press; 1997; pp. 40-1 to 40-17.*
Brandenburg, Karlheinz, "Introduction to Perceptual Coding," *Collected Papers on Digital Audio Bit-Rate Reduction*, pp. 23-31, manuscript received Mar. 13, 1996.

* cited by examiner

*Primary Examiner*—Abul K. Azad
(74) *Attorney, Agent, or Firm*—Alan L. Pedersen-Giles

(57) ABSTRACT

A system and method of encoding an audio stream includes generation of a distortion threshold templates database that is accessible by a perceptual audio encoder. The audio encoder utilizes the threshold templates to operate a compression algorithm, obviating the need to implement a psycho-acoustic model to generate a distortion threshold for each compression operation. A similar templates database may be used in a transcoding operation, again bypassing a psycho-acoustic modeling operation and promoting system efficiency.

25 Claims, 6 Drawing Sheets

AUDIO CODING AND TRANSCODING USING PERCEPTUAL DISTORTION TEMPLATES

BACKGROUND OF THE INVENTION

1. Field of the Invention

The system and method described herein relate to enhanced efficiency during audio encoding and transcoding.

2. Discussion of the Related Art

High quality audio compression is normally carried out using perceptual models of the human auditory system (i.e., psycho-acoustic models). An auditory system is often modeled as a filter bank that decomposes an audio signal into banks referred to as critical bands. A critical band consists of one or more audio frequency components that are treated as a single entity. Some audio frequency components can mask other components within a critical band (i.e., intra-masking) and components from other critical bands (i.e., inter-masking). Though the human auditory system is highly complex, models thereof have been successfully used to achieve high quality compression.

A perceptual audio encoder attempts to achieve transparent compression (i.e., decompressed audio perceptually equal to the original audio) by using a psycho-acoustic model, and by maintaining quantization noise just below the level at which it later becomes audible to a listener (FIG. 2). Perceptual audio coding is the basis for such compression algorithms as Motion Pictures Experts Group ("MPEG")-1 Layer 3 ("MP3") and advanced audio coding ("AAC").

Many algorithms that model the human auditory system have been proposed. By way of example, the MPEG standard specifies two different psycho-acoustic model versions; dubbed Versions 1 and 2. Though a number of algorithms are commonly implemented, the basic methodology generally remains the same: (1) decompose an audio input signal into a spectral domain (Fast Fourier Transform, or "FFT," being the most widely used tool for this operation); (2) group spectral bands into critical bands (in MPEG algorithms, this entails mapping from FFT samples to M critical bands); (3) determine tonal and non-tonal (i.e., noise-like) components within the critical bands; (4) calculate the individual masking thresholds for each of the critical band components by using the energy levels, tonality, and frequency positions; and (5) compute a distortion threshold (sometimes referred to as a masking threshold).

Perceptual audio encoders, such as MP3 and AAC, rely on complex mathematical models of the auditory system to implement the methodology described above; the complexity owing at least in part to efforts to minimize the perception of quantization errors in the signal. To that end, these encoders as well as other conventional applications generally employ FFT operations that are CPU-intensive, requiring the execution of numerous CPU cycles for completion. Because many CPU cycles must be delegated to such operations, there may be correspondingly fewer CPU cycles available to other applications or operations in a computing or similar system while performing a coding operation on an audio stream. Such large system demands may decrease overall efficiency.

Accordingly, there is a need for a system and method for efficiently achieving perceptual audio coding and transcoding that does not require the utilization of complex psycho-acoustic models during an encoding operation.

DETAILED DESCRIPTION

The present invention provides a system and method for achieving perceptual audio coding and/or transcoding with enhanced performance efficiency. A first embodiment of the present invention may include two components: a distortion template generation component and a perceptual audio coding component. In the distortion template generation component, psycho-acoustic distortion thresholds may be generated and stored in a templates database that is accessible by audio coding or transcoding algorithms implemented in an audio encoder. In the perceptual audio coding component, the distortion templates stored in the templates database may be "smartly" used in algorithms, such as MP3 and AAC, to achieve efficient audio compression of an input audio stream.

Figure 1:
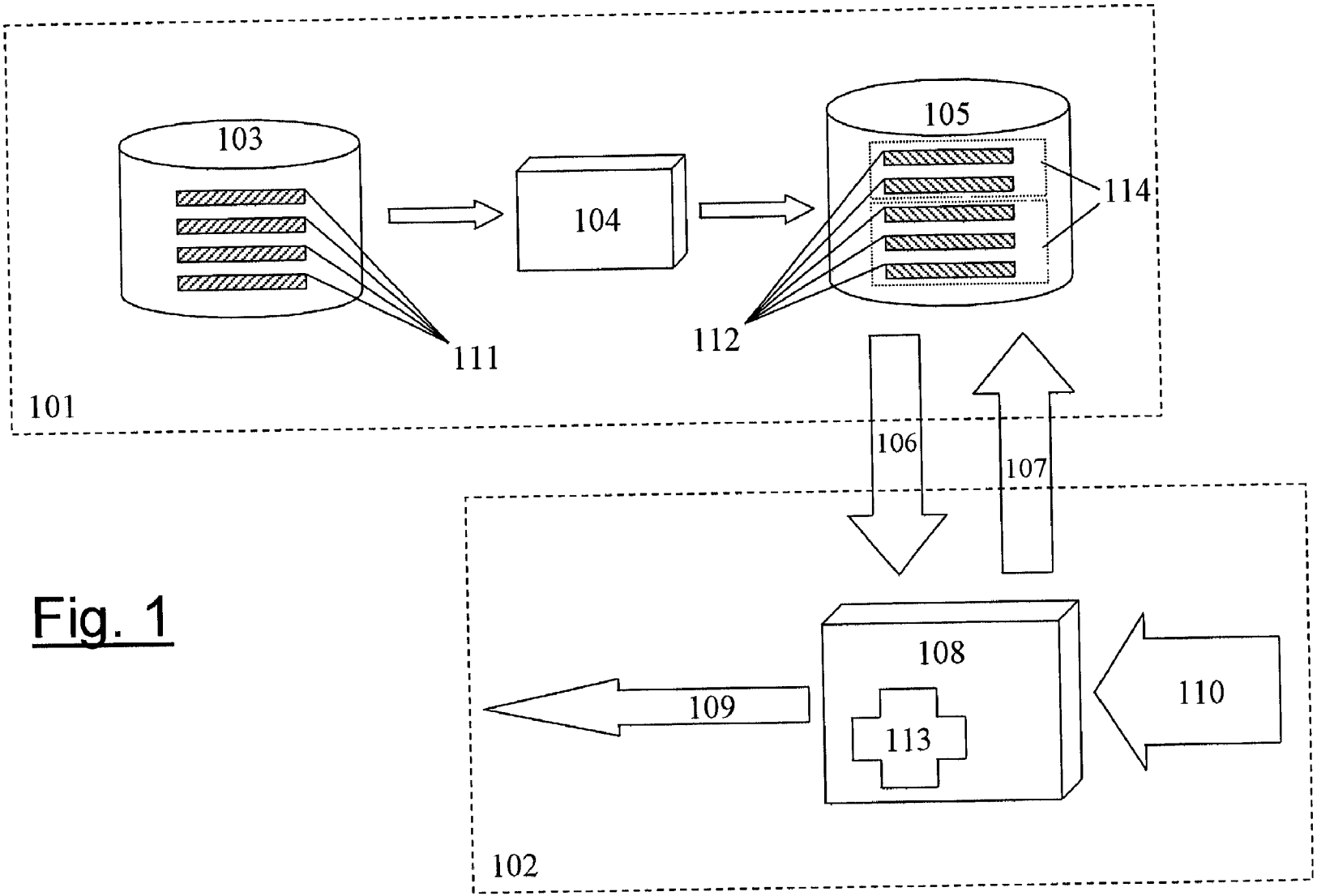
FIG. 1 depicts a schematic representation of a distortion template generation component, a perceptual audio coding component, and interaction therebetween in accordance with an embodiment of the present invention.
Figure 2:
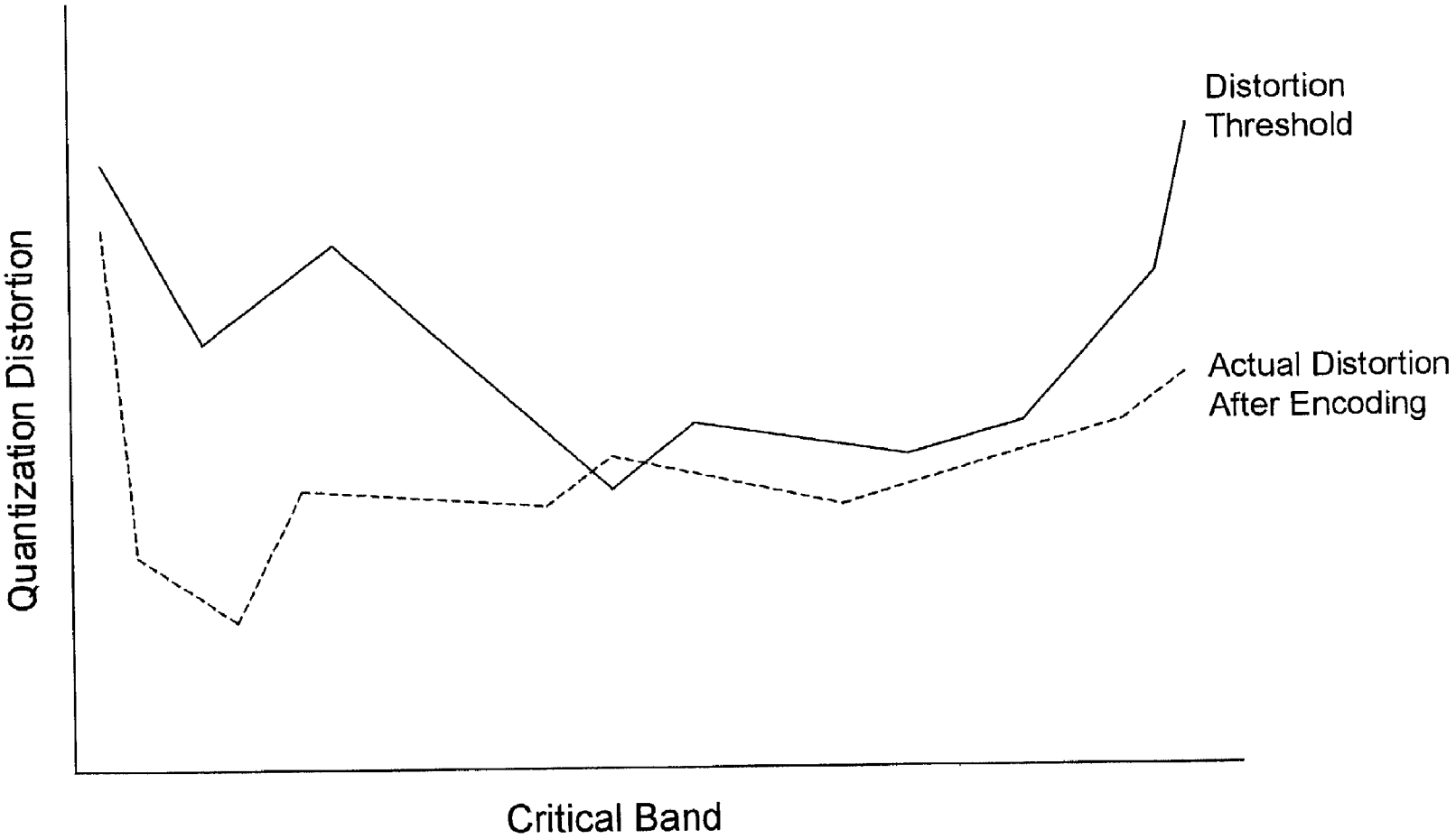
FIG. 2 graphically depicts use of a conventional distortion threshold by an audio coding algorithm in accordance with an embodiment of the present invention.

Referring to FIG. 1, a distortion template generation component 101 and a perceptual audio coding component 102 may be included in an embodiment of the present invention. In the distortion template generation component 101, a templates database 105, which contains distortion templates 112 of psycho-acoustic thresholds, may be generated. The distortion templates 112 populating the templates database 105 may be used by an audio coding algorithm 113 in the audio coding component 102 during a compression operation. An algorithm 113 using these distortion templates 112 may not need to utilize CPU-intensive modeling of an incoming audio stream 110 to generate distortion thresholds. Rather, the algorithm 113 may select a preexisting distortion template 112 from the templates database 105 to employ during the compression operation. This selection may obviate the need for FFT transforms and critical band analysis; promoting system efficiency.

Other subcomponents may be included in the distortion template generation component 101, including an audio excerpts database 103, a psycho-acoustic model 104, and a classification scheme included in the templates database 105. The utilization of these components is illustratively described in Example 1 below. More complex distortion template generation techniques than that described in the ensuing Example 1 may be implemented in accordance with alternate embodiments of the present invention and are contemplated as being within the scope thereof.

The generation of distortion templates 112 in the distortion template generation component 101 may be based upon information stored in the audio excerpts database 103. This audio excerpts database 103 may be adapted according to end-user goals. For instance, if the audio coding algorithm 113 that will ultimately utilize the distortion templates 112 is for generic music purposes, then the audio excerpts 111 populating the audio excerpts database 103 may be selected to include a variety of music genres (e.g., pop, rock, jazz, etc.). If, however, the audio coding algorithm 113 is to be used mostly with one particular music genre (e.g., classical), then the audio excerpts database 103 may be populated either mostly or entirely with audio excerpts 111 of that music genre. A wide array of database population strategies may thus be used to populate the audio excerpts database 103.

The psycho-acoustic model 104 that may be used in accordance with an embodiment of the present invention may be able to estimate distortion thresholds 112 with great accuracy (i.e., a "golden" psycho-acoustic model). Greater accuracy in estimation typically equates to higher quality distortion templates 112, and, correspondingly, greater transparency in encoding operations performed by embodiments of the present invention. Since distortion templates 112 need only be generated once per application purpose (i.e., the psycho-acoustic model 104 need not be implemented for each individual encoding operation), the complexity of the psycho-acoustic model 104 is not a limiting factor. Therefore, it may be desirable to employ the best psycho-acoustic model 104 available, regardless of its efficiency parameters, though any appropriate psycho-acoustic model 104 may be used. Moreover, as technology evolves and the understanding of the human auditory system improves, new psycho-acoustic models may be developed and implemented, and the templates database 105 may be updated accordingly.

Figure 3:
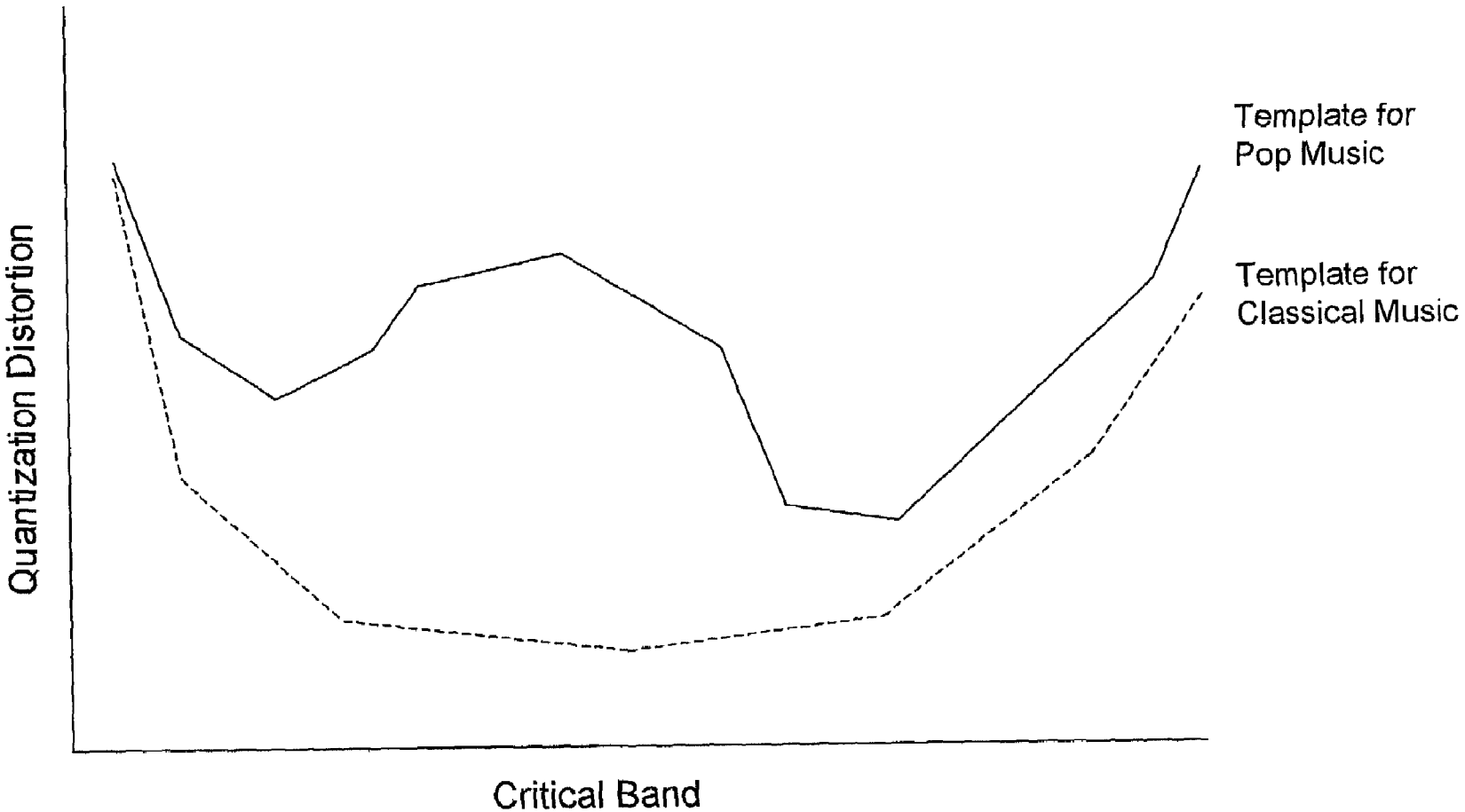
FIG. 3 graphically depicts an example of distortion templates generated as a function of music genre in accordance with an embodiment of the present invention.
Figure 4:
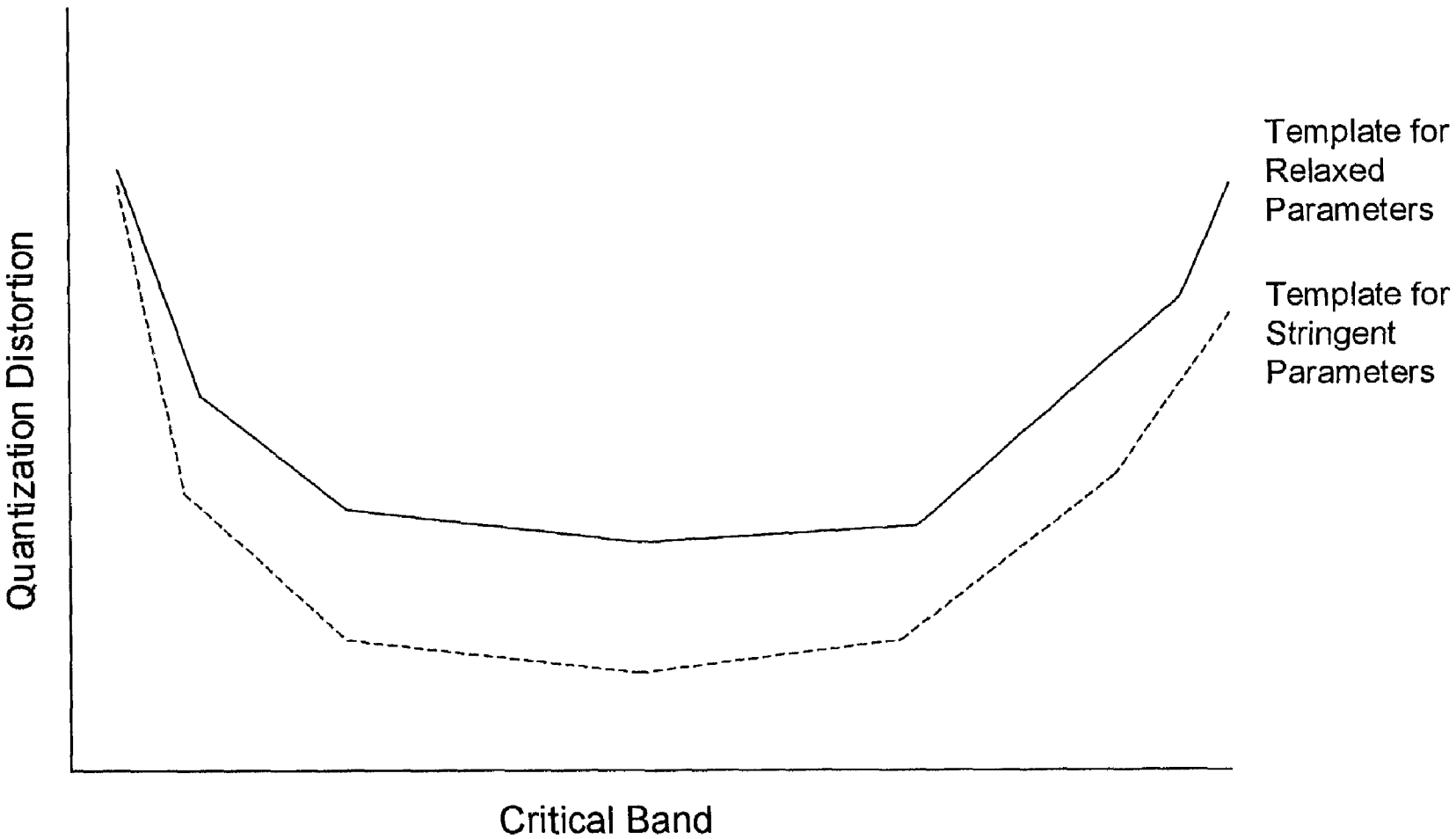
FIG. 4 graphically depicts an example of distortion templates generated as a function of model parameters in accordance with an embodiment of the present invention.

The distortion templates 112 generated in the distortion template generation component 101 may be grouped according to any desirable number of classes 114 based on music genre, model parameters, or other appropriate classifications, and stored in the templates database 105. In this manner, an audio encoder 108 included in the audio coding component 102 may have the option of using different distortion templates 112 according to particular desired criteria. In the simplest instance, there is only one class 114 of distortion template 112 (e.g., a generic distortion threshold template that is used for all audio tracks to be encoded). However, in more complex scenarios, a greater number and variety of classes 114 may be included. FIGS. 3 and 4 present a variety of scenarios where distortion templates are generated according to particular classifications, though combinations of various classifications may also be implemented (e.g., a combination of music genre and model parameter).

An audio coding component 102, in accordance with an embodiment of the present invention, may include a perceptual audio encoder 108 which receives incoming (e.g., uncompressed) audio data 110 that is to be encoded, and outputs encoded (e.g., compressed) audio data 109. The perceptual audio encoder 108 may employ the same psycho-acoustic model used to generate the distortion thresholds 112 in the distortion threshold generation component 101. As such, the perceptual audio encoder 108 may interact with the templates database 105 by applying a threshold selection control 107 that selects a particular distortion threshold template 112 for use with the algorithm 113 being utilized in the perceptual audio encoder 108; a selected threshold 106 being transmitted to the perceptual audio encoder 108 in response to the threshold selection control 107. By selecting a distortion threshold 112 to implement in the encoding operation, the audio coding component 102 may perform an encoding operation without implementing the psycho-acoustic model and generating a new distortion threshold.

The selection of an appropriate distortion template 112 with a selection control 107 may occur in any suitable fashion, depending on the application. By way of example, various embodiments may include, but are not limited to: user selection of a music genre via an interface, this user selection prompting the perceptual audio encoder 108 to employ a corresponding distortion template 112; retrieval of music genre data from metadata included with incoming audio data 110 that prompts the perceptual audio encoder 108 to employ a particular distortion template 112; system selection of a distortion template 112 based on quality/speed tradeoffs; or retrieval of low order statistical features from incoming audio data 110 (e.g., mean value and standard deviation) that prompt the perceptual audio encoder 108 to select a particular distortion template 112. Numerous other scenarios are also suitable for use in accordance with the present invention. However, because the psycho-acoustic model itself may be used in the present invention, more complex scenarios are not required.

The system and method of the present invention may be used in the encoding of audio files, yet, in another embodiment of the instant invention, transcoding of compressed audio files may be performed. As used herein, transcoding is the process of converting a compressed audio stream of a particular coding format into a second compressed stream of the same coding format including different compression attributes. In some applications, one compression attribute that is desirably modified in this fashion is the coding bit rate, which defines the total amount of compression achieved in an audio stream. For example, it may be desirable to convert high quality audio coded at 256 kbits/sec to a lower bit rate (e.g., 96 kbits/sec) to enable transmission of this audio stream via low capacity communication channels, such as a low bandwidth RF connection. Similarly, a media appliance, such as a media port that connects to a server where high quality MP3-encoded audio is stored, may be required to transmit an audio stream as low bit rate audio to "thin" clients, such as a personal digital assistant ("PDA"), or a Pocket PC that is constrained by memory capacity.

A decompression/compression process, wherein compressed audio is first decoded into its original raw form and then recompressed with new compression attributes, is often implemented, yet this methodology for transcoding may be inefficient, as it requires numerous CPU-intensive steps. While the invention is not limited to a particular theory, it is more efficient to utilize a common intermediate audio representation ("CIAR") of the compressed audio data that suffices for the application of a compression algorithm with the new attributes.

Figure 5:
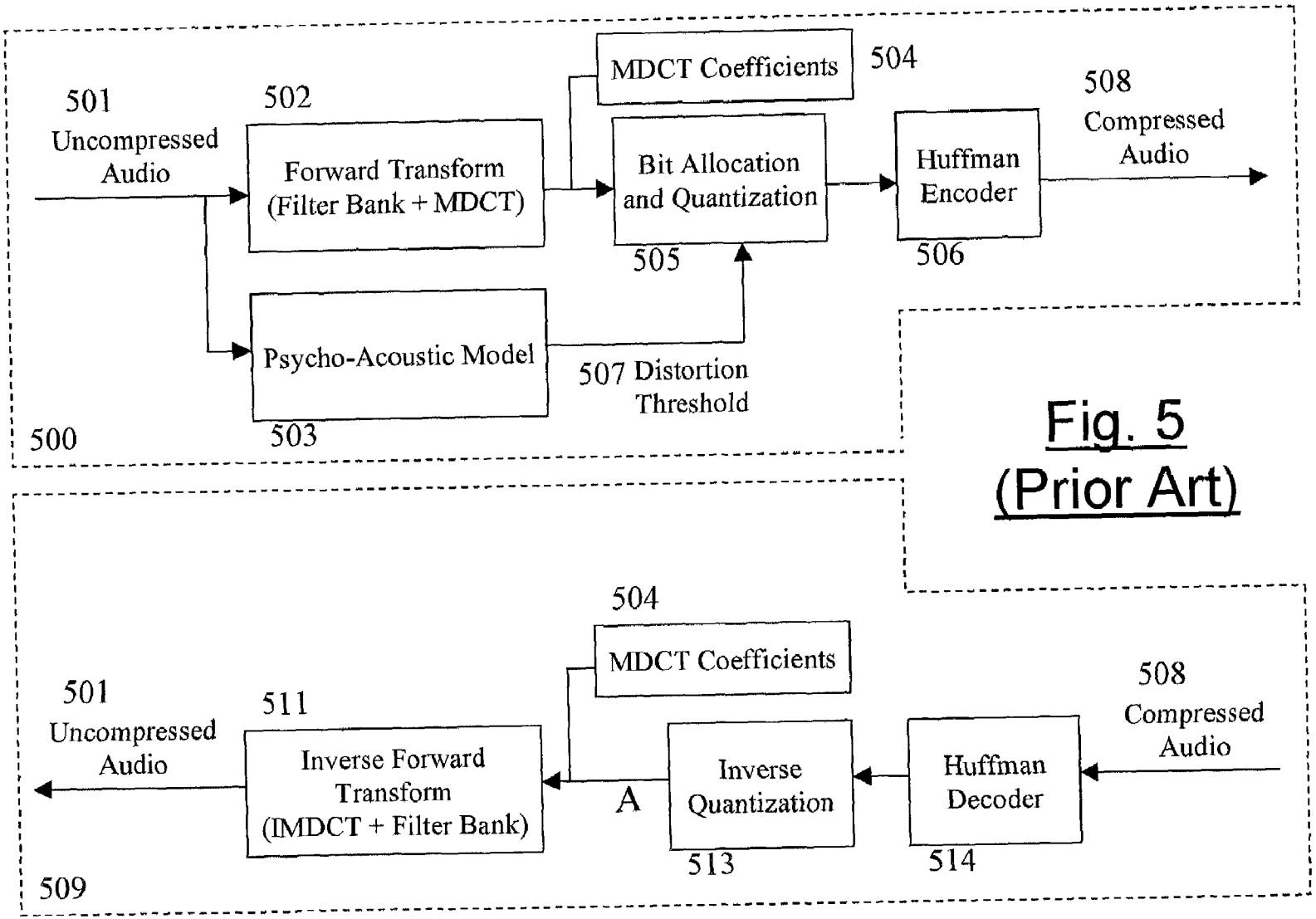
Fig. 5 (Prior Art)
FIG. 5 depicts a high-level, schematic overview of a conventional MP3 encoding/decoding process in accordance with the prior art.

For most conventional audio coders, such a CIAR already exists. By way of example, FIG. 5 depicts a high-level diagram of an MP3 encoding/decoding process (500/509, respectively). Uncompressed audio 501 is transformed into a frequency representation via the use of polyphase filter banks and a modified discrete cosine transform ("MDCT") 502. The MDCT coefficients 504 are then used in the bit allocator 505 to meet the desired bit rate. As a perceptual audio encoder, the bit allocator 505 uses distortion thresholds 507 generated from a psycho-acoustic model 503 to divide the amount of quantization 505 to apply to each critical bank in the MDCT domain. A Huffman Encoder 506 may be included to complete the encoding process 500, outputting compressed audio 508. In the decoding process 509, compressed audio 508 may be processed through a Huffman Decoder 514, and the quantized MDCT coefficients 504 dequantized 513. An inverse MDCT ("IMDCT")/ filter bank transform is then applied 511 to the values to recover the original, uncompressed signal 501.

In a transcoding process using conventional methods as described above, the MDCT coefficients 504 must be inverse transformed to recover the original signal 501. This inverse transformation is followed by retransformation of the original signal into the MDCT domain. This is a redundant process, since an MDCT representation of the signal is already in existence by the point in the transcoding process at which the signal is being retransformed (indicated as point "A" in FIG. 5). In these conventional systems, the transform must be reverted and eventually reapplied because, in order to change bit rate attributes, distortion thresholds must be regenerated from the psycho-acoustic model, as they are not transmitted as ancillary data with the MP3 bitstream. Therefore, the original signal must be recovered in order to reapply the psycho-acoustic model. Transmission of the distortion thresholds as ancillary data would require increased bit rate demands, which would likely compromise audio quality.

Figure 6:
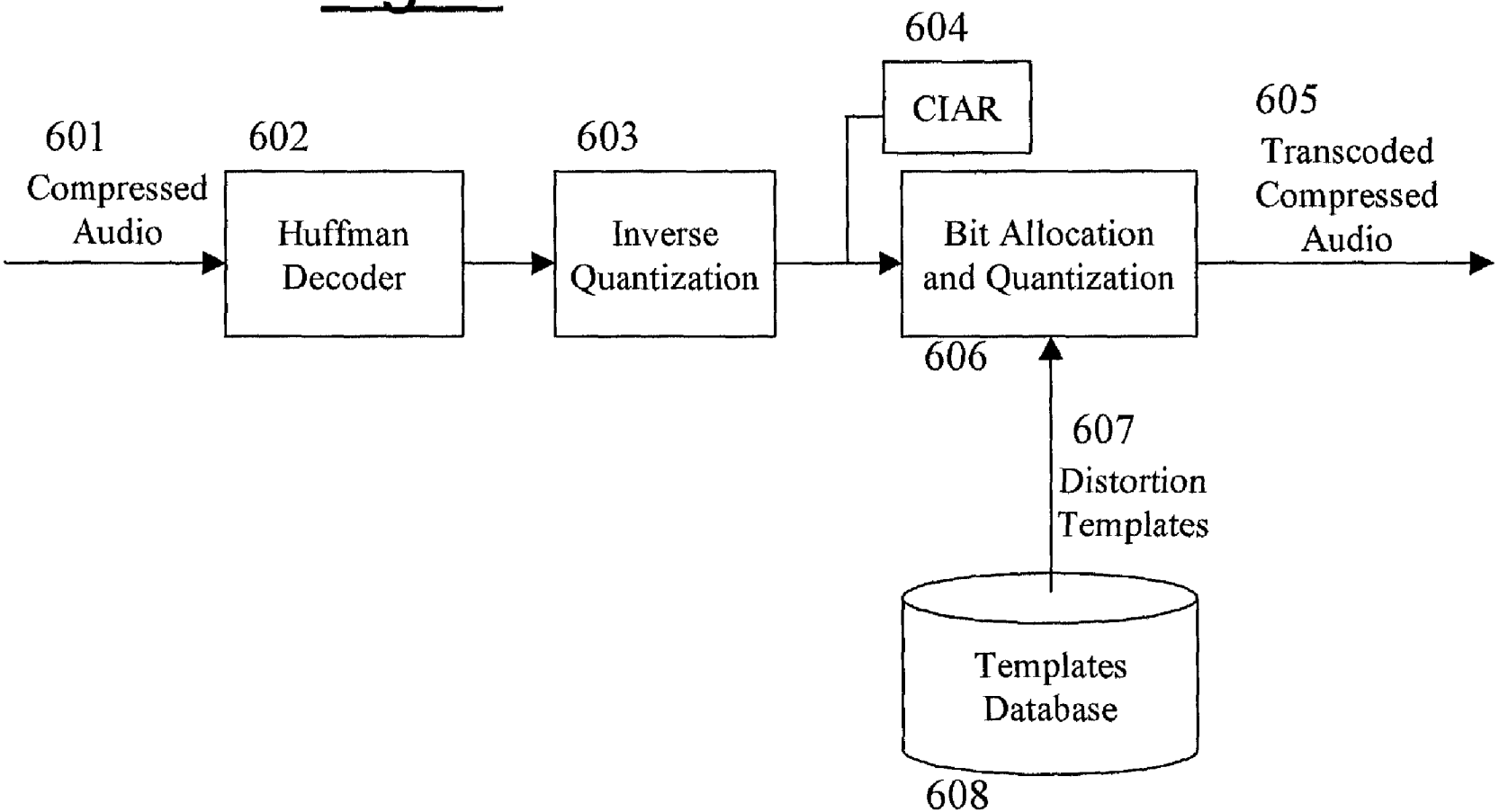
FIG. 6 depicts a schematic representation of an audio transcoder using distortion threshold templates in accordance with an embodiment of the present invention.

Thus, in an embodiment of the present invention, as depicted in FIG. 6, the CIAR may be the MDCT coefficients resulting from the frequency transformation process in the encoder. Perceptual distortion threshold templates 607 stored in a templates database 608 and generated as described above may be used in the bit allocation and quantization 606. Therefore, because the psycho-acoustic modeling step in the encoder may be bypassed via the use of such threshold distortion templates 607, the original signal 601 need not be recovered to achieve the new desired bit rate in the transcoded, compressed outgoing signal 605. Instead, compressed audio 601 may be inverse quantized 603, followed by bit allocation and quantization using the CIAR 604 and the distortion templates 607. FIG. 6 depicts the implementation of this embodiment of the instant invention, using a database of generated perceptual thresholds 608 generated as described above, in an audio transcoding process, and also including a Huffman Decoder 602.

EXAMPLE 1

Distortion Template Generation Process for MP3 Encoding

The generation of distortion templates to be used for MP3 encoding is performed on a database of audio excerpts. Each audio excerpt illustratively consists of 30 seconds of audio data. The audio excerpts are analyzed according to psycho-acoustic criteria and, because the encoding algorithm is known (e.g., an MP3 encoding algorithm), the excerpts may be treated exactly as an incoming, uncompressed audio stream will be by the encoder. Distortion threshold templates are thereby generated and stored in a templates database.

In MP3 encoding, a digital signal is processed in blocks of 1152 samples divided into two "granules" of 576 samples. Each granule is processed through a psycho-acoustic model to generate a vector of 23 values corresponding to the distortion thresholds in 23 critical bands. Therefore, one strategy may be to process each 30-second audio excerpt and store every psycho-acoustic model output vector per granule. However, this strategy will result in a huge file for each audio track, quickly becoming unmanageable. Time and memory constraints associated with this technique may be alleviated by, instead, taking random samples of the psycho-acoustic model outputs, though a number of other methodologies may similarly obviate this problem. At the termination of the sampling process, N vectors of M distortion thresholds are stored per classification (e.g., music genre, parameters, etc.) in accordance with a classification scheme in a templates database, where N>>1 and M=23 for MP3. In a simple case, an average is taken across the N vectors, $t_n$, resulting in one mean vector, $\bar{t}$, of M distortion thresholds per classification:

$$\bar{t}[m] = \frac{1}{N}\sum_{n=0}^{N-1} t_n[m] \quad m = 0, 1, \ldots, M-1$$

More advanced statistical techniques may be used to compose each distortion template (e.g., outlier analysis, covariance analysis to estimate the statistical basis functions, etc.).

The resulting distortion templates (one distortion template per classification) are stored in a templates database that is accessible by an audio coding algorithm in a perceptual audio encoder that performs an encoding or transcoding operation.

While the description above refers to particular embodiments of the present invention, it will be understood that many modifications may be made without departing from the spirit thereof The accompanying claims are intended to cover such modifications as would fall within the true scope and spirit of the present invention. The presently disclosed embodiments are therefore to be considered in all respects as illustrative and not restrictive, the scope of the invention being indicated by the appended claims, rather than the foregoing description, and all changes that come within the meaning and range of equivalency of the claims are therefore intended to be embraced therein.

What is claimed is:

1. An audio coding system, comprising:

a template generation component to generate templates for use in an audio coding operation, said template generation component including a templates database populated by at least one distortion threshold template that includes psycho-acoustic thresholds over a range of frequencies; and an audio coding component that performs an audio coding operation, said audio coding operation utilizing said at least one distortion threshold template, said template generation component further including:

an audio excerpts database populated by at least one audio excerpt; and a psycho-acoustic model that creates said at least one distortion threshold template, said psycho-acoustic model utilizing said at least one audio excerpt.

2. The audio coding system of claim 1, said template generation component further including:

a classification scheme to classify said at least one distortion threshold template into at least one class.

3. The audio coding system of claim 1, wherein said audio coding operation includes an algorithm that utilizes said at least one distortion threshold template, and said audio coding component further includes an audio encoder that implements said algorithm to convert an uncompressed audio signal into a compressed audio signal.

4. The audio coding system of claim 1, said audio coding operation including a selection control to select said at least one distortion threshold template.

5. The audio coding system of claim 1, wherein said audio coding operation is a transcoding operation that alters a compression attribute of an audio stream to generate a transcoded audio stream.

6. The audio coding system of claim 5, wherein said attribute is a bit rate.

7. The audio coding system of claim 5, said transcoding operation further including an inverse quantization operation and a bit allocation and quantization operation that utilizes said at least one distortion threshold template.

8. The audio coding system of claim 7, said bit allocation and quantization operation utilizing a common intermediate audio representation (CIAR).

9. The audio coding system of claim 8, wherein said CIAR is a set of modified discrete cosine transform (MDCT) coefficients.

10. A method of coding an audio stream, comprising:

providing a database populated by at least one distortion threshold template;

providing an audio coding component that performs an audio coding operation that utilizes said at least one distortion threshold template that includes psycho-acoustic thresholds over a range of frequencies;

receiving an incoming audio stream;

performing said audio coding operation utilizing said at least one distortion threshold template on said incoming audio stream;

producing a coded audio stream; and generating said database of said at least one distortion threshold template, including:

providing an audio excerpts database populated by at least one audio excerpt, providing a psycho-acoustic model suitable for creating distortion threshold templates based on audio excerpts, and creating said at least one distortion threshold template with said at least one audio excerpt by implementation of said psycho-acoustic model.

11. The method of claim 10, said generating said database further including classifying said at least one distortion threshold template into at least one class.

12. The method of claim 10, wherein said audio coding operation further includes an algorithm that utilizes said at least one distortion threshold template, and said performing said audio coding operation further includes:

selecting said at least one distortion threshold template; and implementing said algorithm to convert said incoming audio stream into said coded audio stream.

13. The method of claim 10, wherein said audio coding operation is a transcoding operation, said coded audio stream is a transcoded audio stream, and said performing said audio coding operation further includes altering a compression attribute of said incoming audio stream.

14. The method of claim 13, wherein said compression attribute is a bit rate.

15. The method of claim 13, wherein said performing said audio coding operation further includes:

performing an inverse quantization operation; and performing a bit allocation and quantization operation that utilizes said at least one distortion threshold template.

16. The method of claim 15, said performing said bit allocation and quantization operation further including implementing a common intermediate audio representation (CIAR).

17. The method of claim 16, wherein said CIAR is a set of modified discrete cosine transform (MDCT) coefficients.

18. A program code storage device, comprising:

a machine-readable storage medium; and machine-readable program code, stored on the machine-readable storage medium, the machine-readable program code having instructions to:

provide a database populated by at least one distortion threshold template;

provide an audio coding component that performs an audio coding operation that utilizes said at least one distortion threshold template that includes psycho-acoustic thresholds over a range of frequencies;

receive an incoming audio stream;

perform said audio coding operation utilizing said at least one distortion threshold template on said incoming audio stream;

produce a coded audio stream; and generate said database of said at least one distortion threshold template, wherein said instructions to generate said database further include instructions to:

provide an audio excerpts database populated by at least one audio excerpt, provide a psycho-acoustic model suitable for creating distortion threshold templates based on audio excerpts, and create said at least one distortion threshold template with said at least one audio excerpt by implementation of said psycho-acoustic model.

19. The device of claim 18, wherein said instructions to generate said database further include instructions to classify said at least one distortion threshold template into at least one class.

20. The device of claim 18, wherein said audio coding operation further includes an algorithm that utilizes said at least one distortion threshold template, and said instructions to perform said audio coding operation further include instructions to:

select said at least one distortion threshold template; and implement said algorithm to convert said incoming audio stream into said coded audio stream.

21. The device of claim 18, wherein said audio coding operation is a transcoding operation, said coded audio stream is a transcoded audio stream, and said instructions to perform said audio coding operation further include instructions to alter a compression attribute of said incoming audio stream.

22. The device of claim 18, wherein said compression attribute is a bit rate.

23. The device of claim 18, wherein said instructions to perform said audio coding operation further include instructions to:

perform an inverse quantization operation; and perform a bit allocation and quantization operation utilizing said at least one distortion threshold template.

24. The device of claim 23, wherein said instructions to perform said bit allocation and quantization operation further include instructions to implement a common intermediate audio representation (CIAR).

25. The device of claim 24, wherein said CIAR is a set of modified discrete cosine transform (MDCT) coefficients.

* * * * *